US005913665A

United States Patent [19]

Sundby et al.

[11] Patent Number: 5,913,665

[45] Date of Patent: Jun. 22, 1999

[54] FILL PUMP WITH ROLLING DIAPHRAGMS ATTACHED BY VACUUM TO THE PISTON

[75] Inventors: Paul C. Sundby, Mahtomedi; Kenneth M. Eno, Burnsville; Jonathan P. Buesing, Maplewood, all of Minn.

[73] Assignee: Tetra Laval Holdings & Finance, SA, Pully, Switzerland

[21] Appl. No.: 08/828,312

[22] Filed: Mar. 28, 1997

[51] Int. Cl.[6] ..... F04B 13/00; F04B 43/14

[52] U.S. Cl. ..... 417/413.1; 417/416; 417/568; 92/98 D

[58] Field of Search ..... 417/413.1, 416, 417/568; 92/90, 96, 98 R, 98 D

[56] References Cited

U.S. PATENT DOCUMENTS

| | | | |
|---|---|---|---|
| 2,731,534 | 1/1956 | Hansen et al. | 219/4 |
| 3,373,694 | 3/1968 | Taplin . | |
| 3,391,644 | 7/1968 | Taplin | 92/82 |
| 3,538,357 | 11/1970 | Barthalon . | |
| 3,542,495 | 11/1970 | Barthalon . | |
| 3,976,402 | 8/1976 | Lundquist . | |
| 4,002,935 | 1/1977 | Brauer . | |
| 4,046,137 | 9/1977 | Curless et al. . | |
| 4,334,180 | 6/1982 | Bramm et al. . | |
| 4,569,378 | 2/1986 | Bergandy . | |
| 4,729,238 | 3/1988 | Bergmans | 73/239 |
| 4,754,776 | 7/1988 | McKee . | |
| 4,830,232 | 5/1989 | Greenberg et al. . | |
| 4,874,299 | 10/1989 | Lopez et al. . | |
| 4,960,038 | 10/1990 | Chiba et al. | 92/98 R |
| 5,011,379 | 4/1991 | Hashimoto . | |
| 5,090,299 | 2/1992 | Santi et al. . | |
| 5,312,233 | 5/1994 | Tanney et al. . | |
| 5,452,993 | 9/1995 | Lanigan . | |
| 5,488,812 | 2/1996 | Stark et al. | 53/266.1 |
| 5,492,449 | 2/1996 | Hunklinger et al. . | |
| 5,540,568 | 7/1996 | Rosen et al. . | |
| 5,848,738 | 12/1998 | Sundby et al. | 222/380 |

*Primary Examiner*—Timothy S. Thorpe
*Assistant Examiner*—Ehud Gartenberg

[57] ABSTRACT

A pump mechanism for a fill system of a packaging machine is set forth. The pump mechanism is utilized to pump a product that is dispensed by the fill system and includes a pump chamber for conducting the product therethrough. A further chamber is disposed proximate the pump chamber and a piston is disposed in the further chamber. The piston has at least one first opening in fluid communication with the further chamber and at least one second opening disposed at a head portion of the piston. The piston further includes at least one channel for providing fluid communication between the first and second openings. A first diaphragm is secured on the head portion of the piston and against the at least one second opening. As such, the first diaphragm is secured to the head portion using suction forces resulting from an underpressure communicated through the first opening to the at least one second opening via the at least one channel. The piston and first diaphragm are reciprocally movable within the further chamber and pump chamber between a first position in which the pump chamber has a first volume and a second position in which the pump chamber has a second volume that is greater than the first volume.

29 Claims, 8 Drawing Sheets

FILL PUMP WITH ROLLING DIAPHRAGMS ATTACHED BY VACUUM TO THE PISTON

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to an apparatus for filling containers, and, more particularly, to a fill pump having an improved configuration for attaching a diaphragm seal therein.

Packaging machines are known that integrate the various components necessary to fill and seal a container into a single machine unit. This packaging process, generally stated, includes feeding carton blanks into the machine, sealing the bottom of the cartons, filling the cartons with the desired contents, sealing the tops of the cartons, and then off-loading the filled cartons for shipping.

Trends within the field of packaging machines point toward increasingly high capacity machines capable of rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and entitled "A Packaging Machine." The machine disclosed in that patent includes a plurality of processing stations, each station implementing one or more processes to form, fill, and seal the containers. Each of the processing stations is driven by one or more servomotors that drive the various components of each of the processing stations. Other packaging machine types include machines sold by Tetra Pak, Inc., under the TR/6™, TR/7™, and TR/8™ trademarks.

The increased throughput and decreased size requirements that packagers have placed on their packaging machines have increased the demands that are placed on the fill systems that are employed. Various apparatus and corresponding methods for filling containers, such as gable-top containers, have therefor been devised for these machines. In accordance with one of the more popular filling methods, the container is lifted from a conveyor to a fill pipe by means of a lifting mechanism. The container lifting mechanism gradually lowers the container as product is dispensed through the fill pipe. The container is lowered until it again engages the conveyor where it is transported to a subsequent processing station, such as a top sealing station. Such a method is utilized in the packaging machines referenced above.

Alternatively, the filling and top sealing operations may be performed at a single location within the machine. In such instances, the container may be top sealed at the filling station after it has been lowered from the fill pipe. Such a method and apparatus are shown and described in the referenced '812 patent.

Many of the foregoing systems utilize a diaphragm for isolating the moving components of the pump mechanism of the fill system from the flow of product. The diaphragm is attached to the head of a piston using, for example, an adhesive bond. During operation of such a system, the piston is driven so that it moves the diaphragm to alternatingly decrease and increase the volume of a pump chamber to expel and suction fluid, respectively. Such repetitive movement creates stress on the adhesive bond attaching the diaphragm to the head of the piston. Over time, the adhesive bond could be subject to failure, and the diaphragm would then be either repaired or replaced. Such failures increase the cost of running the machine and result in costly down time during which the machine is not packaging product. The inventors of the present invention have recognized a need for a fill pump having a diaphragm that secures the diaphragm to its drive while overcoming the problems associated with the current attachment methods.

Another problem encountered with certain pump mechanisms relates to the dosing of the product. More particularly, many systems experience inaccuracies when attempting to dispense uniform volumes of product in a precise and repeatable manner during a high carton throughput filling operation. The inventors of this application have recognized a need for an apparatus that delivers reproducible, precise amounts of product in a high volume filling system.

BRIEF SUMMARY OF THE INVENTION

A pump mechanism for a fill system of a packaging machine is set forth. The pump mechanism is utilized to pump a product that is dispensed by the fill system and includes a pump chamber for conducting the product therethrough. A further chamber is disposed proximate the pump chamber and a piston is disposed in the further chamber. The piston has at least one first opening in fluid communication with the further chamber and at least one second opening disposed at a head portion of the piston. The piston further includes at least one channel for providing fluid communication between the first and second openings. A first diaphragm is secured on the head portion of the piston and against the at least one second opening. As such, the first diaphragm is secured to the head portion using suction forces resulting from an underpressure communicated through the first opening to the at least one second opening via the at least one channel. The piston and first diaphragm are reciprocally movable within the further chamber and pump chamber between a first position in which the pump chamber has a first volume and a second position in which the pump chamber has a second volume that is greater than the first volume.

Other advantages of the present invention will become apparent upon reference to the accompanying detailed description when taken in conjunction with the following drawings.

DETAILED DESCRIPTION OF THE INVENTION

Figure 1:
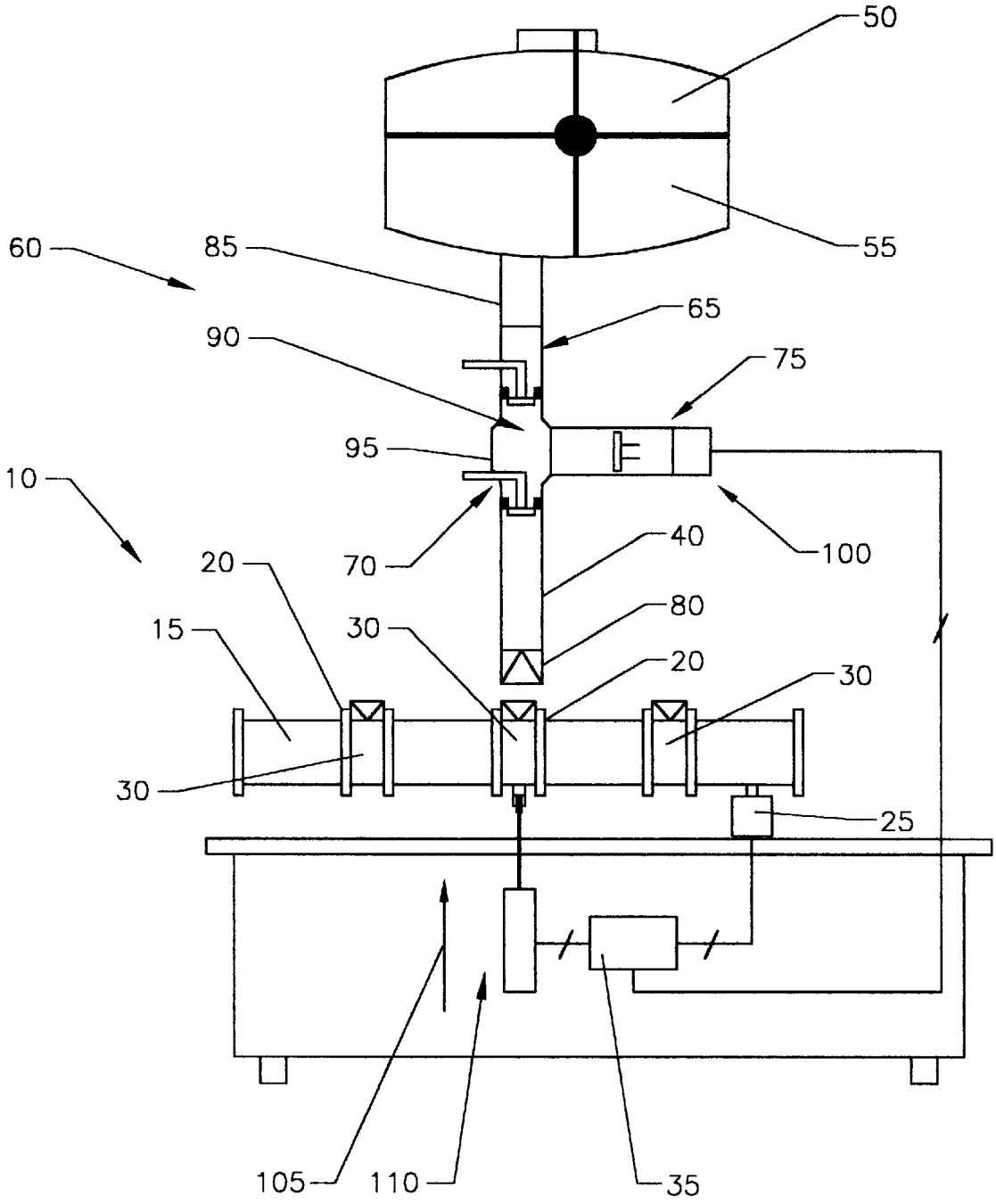
FIG. 1 is a schematic view of a typical filling system of a packaging machine that may incorporate the presently disclosed fill pump mechanism.

FIG. 1 is a partial diagrammatic view of one of the many types of filling machines, shown generally at 10, that may utilize a fill pump mechanism constructed and operated in the manner described herein. As shown in FIG. 1, a conveyor 15 having a plurality of container support members 20 is driven, for example, by a motor 25, such as a servomotor. The support members 20 each support a single, open topped container 30 that has its bottom sealed. The conveyor 15 is driven by the motor 25 under the control of, for example, a programmable control system 35, or the like, to present the containers 30 successively below a fill pipe 40 of the fill system 10.

A storage or balance tank 50 containing a liquid product 55 is connected to provide a flow of the liquid product 55 through a flow control system 60. The flow control system 60, generally stated, comprises an inlet valve assembly 65, an outlet valve assembly 70, a pump mechanism 75, the fill pipe 40, and a nozzle 80. The inlet valve 65 is arranged as part of a product inlet pipe 85. Similarly, the outlet valve 70 is arranged as a part of the fill pipe 40. The inlet valve 65 and outlet valve 70 are operated to control the flow of the liquid product 55 into and from a pump chamber 90 of the pump mechanism 75. The pump mechanism 75 may be driven, for example, by a servomotor 100 under the direction of the programmable control system 35.

As illustrated, the containers 30 are successively brought below the nozzle 80 for filling with the liquid product 55. To this end, each container 30 is lifted in the direction of arrow 105 so that the nozzle 80 is disposed in the interior of the container 30. This lifting may be done using a lifting mechanism 110 that executes a motion profile under the direction of, for example, the programmable control system 35. The flow control system 60 is then operated to fill the container 30 with liquid product 55 as the container 30 is lowered from the nozzle 80 by the lifting mechanism 110, preferably maintaining the nozzle 80 below the level of the liquid product 55 throughout this downward motion.

Figure 2:
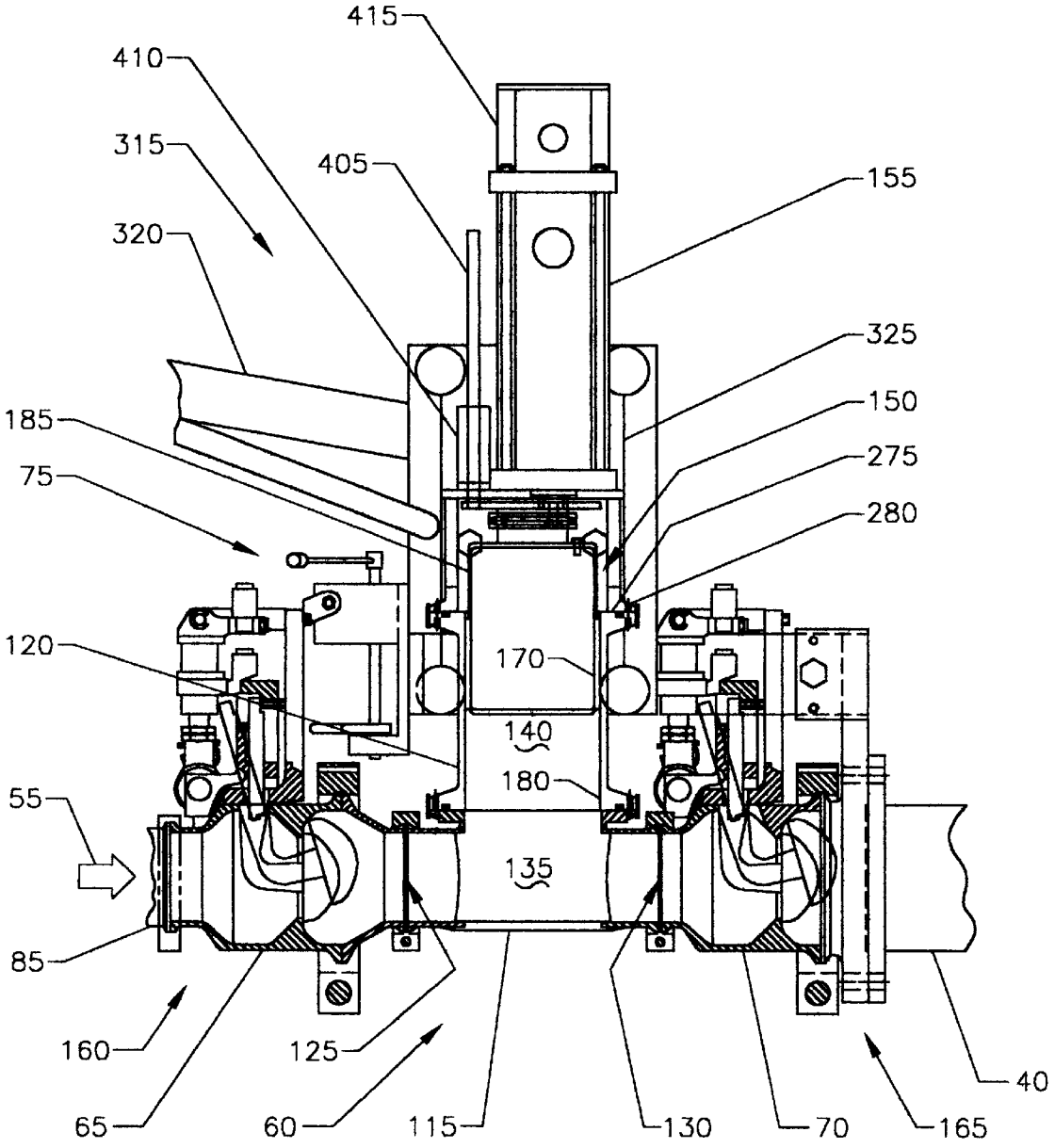
FIG. 2 is a side view in partial cross section of a fill system incorporating an embodiment of the pump mechanism.

One embodiment of the flow control system 60 is illustrated in FIG. 2 wherein like numerals represent like parts. In the illustrated embodiment, the fill pump mechanism 75 is comprised of a pump head 115 and a cylinder 120. The pump head 115 has an inlet 125, an outlet 130, and a pump head chamber 135 in fluid communication with the inlet 125 and outlet 130. In addition, a pump chamber 140 in the cylinder 120 is in fluid communication with the pump head chamber 135. It will be recognized that the pump head chamber 135 and pump chamber 140 need not be separately distinguishable but, rather, may collectively be referred to as a pump chamber.

The fill pump mechanism 75 also includes a piston and diaphragm assembly, shown generally at 150, that is driven to expand and reduce the volume of the pump chamber 140 by, for example, a linear drive mechanism 155. The linear drive mechanism 155 is preferably a servo type unit. An example of a preferred device is a servo linear actuator available from XLAR of Eden Prairie, Minn. Such a linear actuator 155 incorporates an inverted roller screw to provide precise control of the amount of fluid product 55 dispensed by precisely controlling the motion of the piston and associated diaphragms. The linear drive mechanism 155 also provides uniform acceleration of the piston during operation of the fill pump mechanism 75.

The fill pump mechanism 75 is connected to receive product 55 from a product supply system 160 at the inlet 125 of the pump head 115. The product supply system indicated generally at 160 of the illustrated embodiment comprises the product supply tank 50 (see FIG. 1), product inlet pipe 85, and inlet valve assembly 65. The fill pump mechanism 75 is also connected to supply product 55 to a product dispensing system indicated generally at 165. In the illustrated embodiment, the product dispensing system 165 comprises the outlet valve assembly 70 and the product outlet pipe or fill pipe 40. Quick release of the fill pump mechanism 75 during a service cycle of the machine is optionally facilitated by a disconnect system. Details of such a disconnect system are set forth in patent application Ser. No. 08/829436, now U.S. Pat. No. 5,848,738, titled "Fill System Including A Fill Pump Disconnect System", filed on even date herewith.

Figure 3:
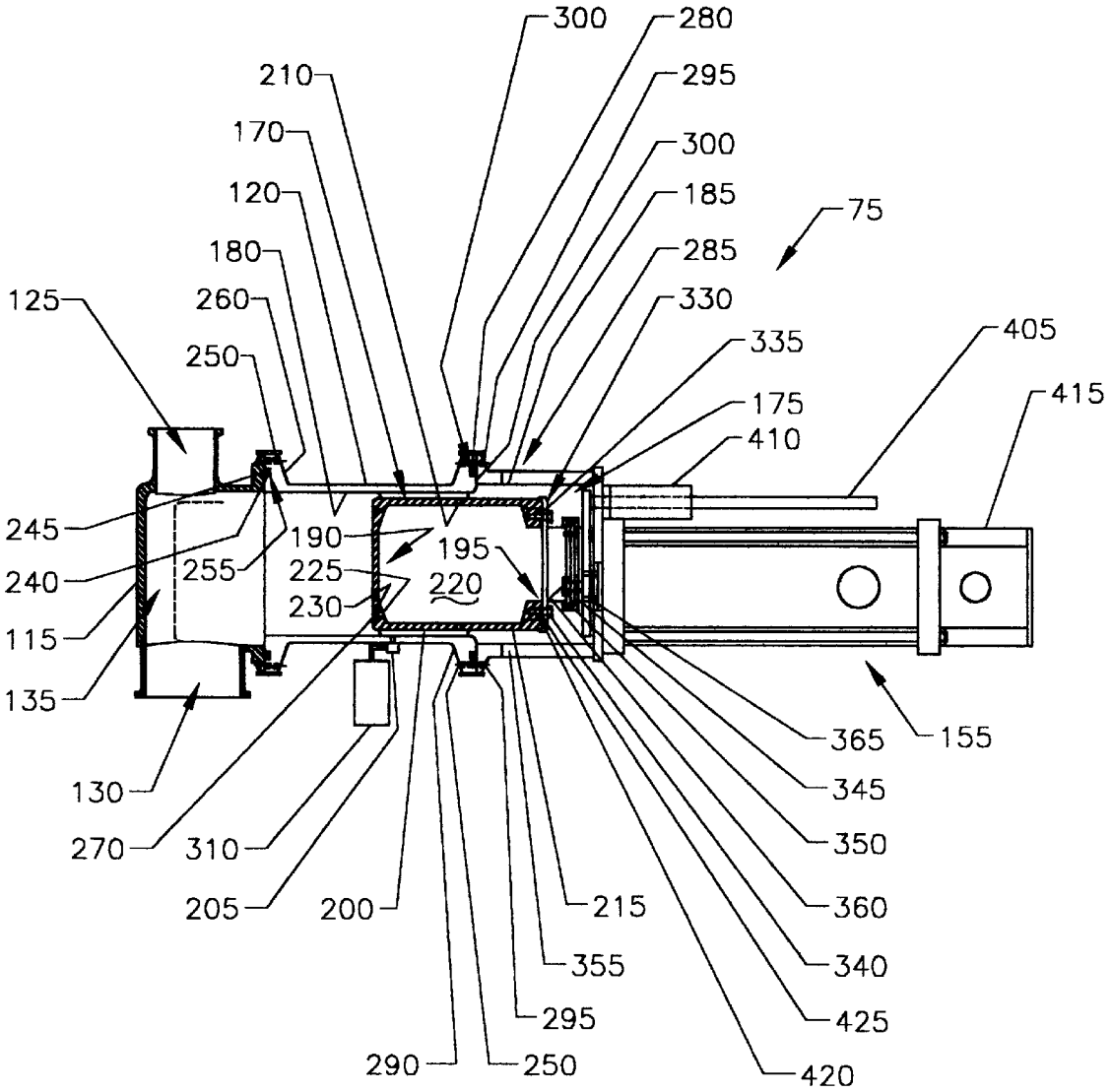
FIG. 3 is a side view in partial cross section of the embodiment of the pump mechanism of FIG. 2 illustrating the piston and diaphragms, arranged in a retracted state.

FIG. 3 is a more detailed view of the fill pump mechanism 75, in partial cross section. As shown, the fill pump mechanism 75 comprises a piston 170 that is connected through an intermediate connection mechanism, shown generally at 175, to the linear actuator 155. The piston 170 is attached to a first diaphragm 180 and a second diaphragm 185. As illustrated in FIG. 3, the piston 170 is attached at a head portion 190 thereof to the first diaphragm 180 and at a second end 195 thereof to the second diaphragm 185.

In operation, the linear actuator 155 moves the piston 170 between a first position in which the pump chamber 140 is in an expanded volume state and a second position in which the pump chamber 140 is in a reduced volume state. The expanded volume state is illustrated in FIGS. 2 and 3, whereas the reduced volume state is illustrated in phantom outline in FIG. 3.

During a production cycle of machine operation, the liquid product 55 is drawn from the product supply tank 50 (see FIG. 1) into the product inlet pipe 85 and passes through inlet valve assembly 65 and inlet 125 into the pump head chamber 135 and pump chamber 140. In this first cycle of operation, the outlet valve 70 is in a closed state. The inlet valve 65 is then closed and the outlet valve 70 is opened while the fill pump mechanism 75 drives the liquid product 55 out of the pump head chamber 135 and pump chamber 140, through outlet 130, outlet valve 70, and the fill pipe 40.

The repetitive reciprocal motion of the piston 170 and first diaphragm 180 creates stress and fatigue on the interconnection between them. As such, prior systems in which the diaphragm is adhesively bonded to the piston have often been subject to failure, thereby allowing the diaphragm to separate from the piston. Additionally, systems employing a mechanical securement to attach the diaphragm to the head of the piston must utilize an opening through the diaphragm. Such an opening may result in reduced machine hygiene.

In accordance with one aspect of the presently disclosed system, the piston 170 and first diaphragm 180 are secured to one another by a unique interconnection arrangement. More particularly, the first diaphragm 180 is secured to the head portion 190 of the piston 170 by creating a suction force at the head portion 190 which suctions a rear portion of the first diaphragm 180 against the piston 170. As will be evident from the operation of the fill pump mechanism 75 described above and below, the suction force need only be present during selected portions of the stroke of the piston 170, since the forward motion of the piston 170 generally generates a pressure against the product 55 that is sufficient to secure the first diaphragm 180 against the head portion 190 of the piston 170.

A series of fluid channels are used to communicate and thereby generate an underpressure between the first diaphragm 180 and the head portion 190 of the piston 170. To this end, a further chamber 200 is disposed adjacent the pump chamber 140. The further chamber 200 is sealed at one end thereof by the first diaphragm 180 and at the other end thereof by, for example, the second diaphragm 185. A vacuum port 205 is provided through a sidewall of the cylinder 120 for connection to a vacuum source.

The piston 170 is provided with at least one aperture 210 therein that is in fluid communication with the further chamber 200. In the illustrated embodiment, a plurality of such apertures 210 are disposed through sidewall 215 of the piston 170. The apertures 210 open to a hollow interior channel or chamber 220 of the piston 170. The piston 170 is further provided with at least one further aperture 225 through the head portion 190 thereof. In the illustrated embodiment, a plurality of such further apertures 225 are provided. These further apertures 225 also open to the interior channel or chamber 220 of the piston 170, thereby placing these further apertures 225 in fluid communication with the further chamber 200. Preferably, these further apertures 225 are disposed evenly about a recessed groove 230 disposed in the head portion 190 of the piston 170.

In the illustrated embodiment, the first diaphragm 180 includes a radially disposed flange 240 having a raised bead 245. The flange 240 is secured at the interconnection between the pump head 115 and the cylinder 120. Together, the pump head 115 and cylinder 120 define the pump chamber 140 while the cylinder 120 defines the further chamber 200.

In the illustrated embodiment, the pump head 115 and cylinder 120 are interconnected using a v-band clamp 250 with the flange 240 interposed therebetween. The raised bead 245 of the first diaphragm 180 engages a corresponding groove 255 in a flange 260 of the cylinder 120 to thereby effect a seal that separates the further chamber 200 from the pump chamber 140.

The first diaphragm 180 also includes a rear face 265 having a raised bead 270 disposed about a peripheral portion thereof. The raised bead 270 is dimensioned to engage and seal with the recessed groove 230 of the head portion 190 of the piston 170. This cooperating bead/groove engagement helps to locate and maintain the diaphram 180 in position on the head portion 190 of the piston 170.

In operation, a vacuum supply is connected to provide an underpressure via the vacuum port 205 of the cylinder 120. This results in evacuation of the further chamber 200 that, in turn, evacuates the internal chamber 220 of the piston 170 through the apertures 210. A suction force is thereby generated between the internal chamber 220 and the first diaphragm 180 through apertures 225 thereby securing the rear face 365 of the first diaphragm 180 against the head portion 190 of the piston 170 during a production cycle of the flow control system 60.

As noted above, the first diaphragm 180 seals the end of the further chamber 200 opposite the second diaphragm 185. In the illustrated embodiment, the second diaphragm 185 includes a flange portion 275 with a raised bead 280. The flange portion 275 is secured at the interconnection between cylinder 120 and a motor cradle 285. The motor cradle 285 is secured to the cylinder 120 using, for example, another v-clamp connection 260. The flange portion 275 of the second diaphragm 185 is secured between a flange 290 of the cylinder 120 and a further flange 295 of the motor cradle 285. The raised bead 280 of second diaphragm 185 engages and seals within a corresponding groove 300 disposed in a face portion 305 of the flange 290 of the cylinder 120 to enhance the seal therebetween.

As further shown in FIG. 3, the vacuum port 205 is arranged in the cylinder 120 such that neither the first diaphragm 180, nor the second diaphragm 185 ever close over the vacuum port 205 within the evacuated inner chamber 220 during the operation of the fill pump mechanism 75. Optionally, a liquid detecting sensor 310 may be provided to sense whether any fluid is present in the hollow chamber 220 as a result of a leak in the first diaphragm 180.

A mounting assembly indicated generally at 315 in FIG. 2 supports the fill pump mechanism 75. The mounting assembly 315 includes a mounting bracket 320, the motor cradle 285, and a plate 325 connected to the motor cradle 285. Further details concerning this support can be found in patent application Ser. No. 08/825135, now U.S. Pat. No. 5,839,486, titled "Fill System Including A Fill Pump Positioning System", and filed on even date herewith.

As shown in FIG. 3, the second diaphragm 185 is connected to the second end 195 of the piston 170 via a connection plate 330 having a mounting surface 335 and a securement 340. In the illustrated embodiment, the securement 340 is a bolt. The second diaphragm 185 is also held between the cylinder 120 and the motor cradle 285. The connection plate 330 is connected to a guide plate 345. The connection plate 330 and the guide plate 345 are held together by means of a clamp 350. The clamp 350 is preferably a modified tri-clamp. The motor cradle 285 includes a cutout portion 355 that provides access to the clamp 350 for repair and maintenance. A securement 360, for example, a bolt, is provided to connect the connection plate 330 and the guide plate 345 to a drive rod 365 of the linear actuator 155.

The foregoing arrangement between the pump head 115, cylinder 120, motor cradle 285, and diaphragms 180, 185 provides a fill pump mechanism 75 that may be readily serviced. This is due, at least in part, to the fact that these components may be readily separated from one another to facilitate access to key components of the system. Such key components include the diaphragms 180, 185 which may be easily inspected and replaced by merely disconnecting the corresponding interconnection 260 and/or 175.

Figure 4:
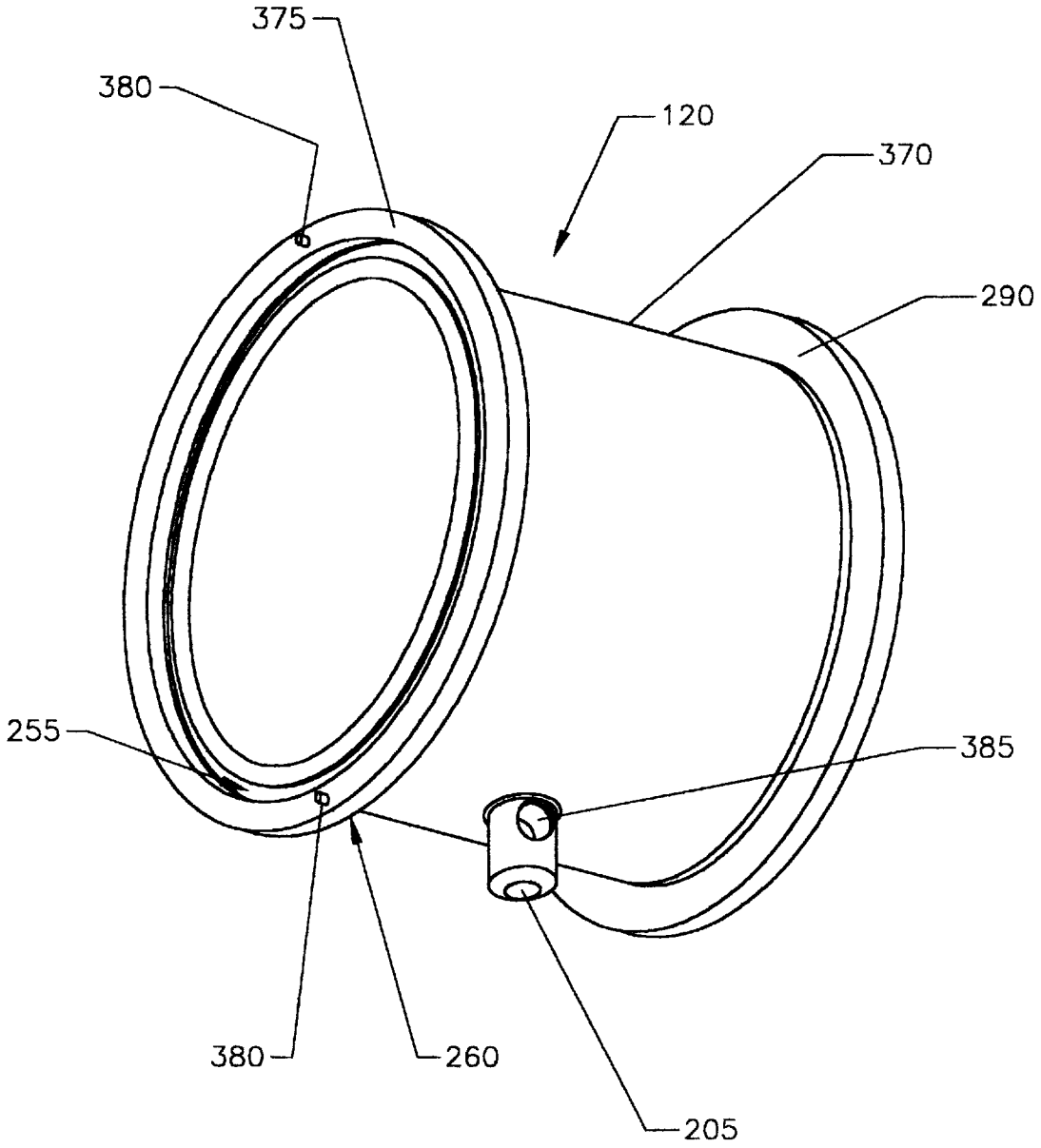
FIG. 4 is a perspective view of an embodiment of the cylinder for use in the pump mechanism of FIG. 2.

FIG. 4 is a perspective view of the cylinder 120. As illustrated, the cylinder 120 comprises flange portions 260, 290 as well as a body portion 370 arranged between the flange portions 260, 290. At least one of the flange portions 260 includes a mounting surface 375 having guide pins 380 disposed thereon for engaging corresponding apertures disposed in flange portions of either the pump head 115 or motor cradle 285. The recessed groove 255 is also shown. The vacuum port connection 205 is provided in the body portion 370 of the cylinder 120. The vacuum port connection 205 has a port 385 for connection of the evacuating mechanism, for example, a vacuum pump.

Figure 5:
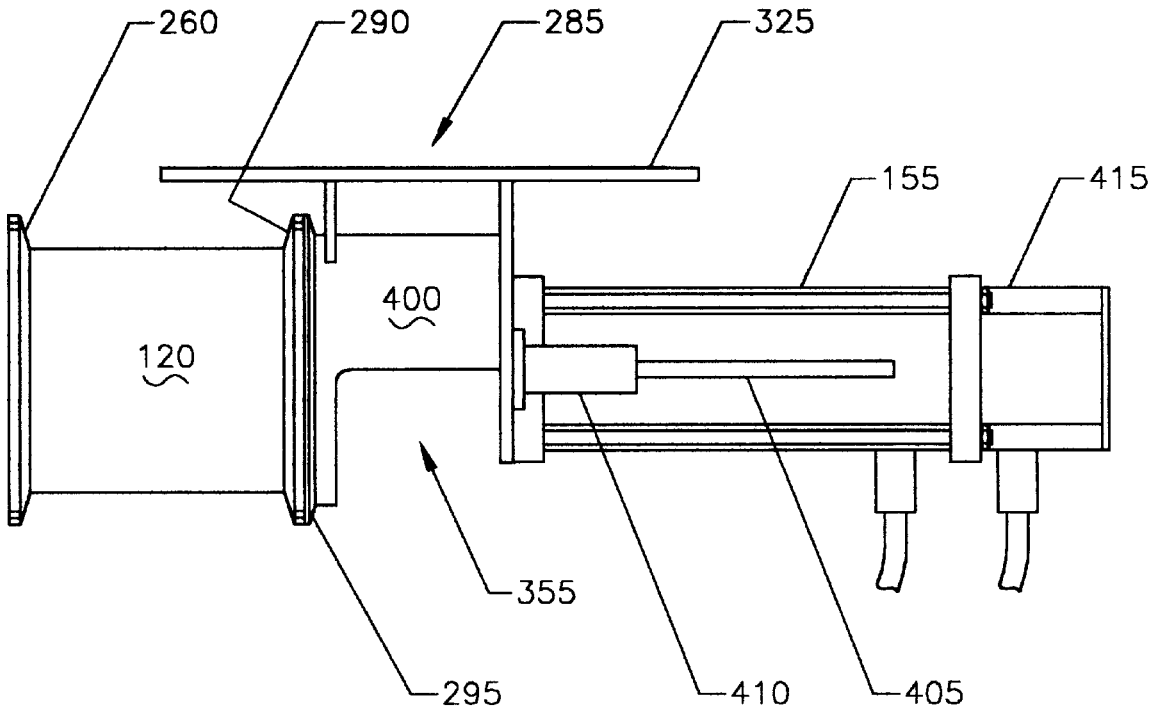
FIG. 5 is a top view of selected components of the embodiment of the pump mechanism of FIG. 2.

FIG. 5 is a top view of the embodiment of the pump mechanism of FIGS. 2 and 3 showing further details thereof. As shown, motor cradle 285 is comprised of a generally cylindrical portion 400 having cutout portion 355. The cutout portion 355 provides access for periodic repair and maintenance as explained above. An anti-rotation rod 405 is in fixed positional alignment with the interconnection mechanism 175. The anti-rotation rod 405 is disposed through a bushing 410 of the motor cradle 285. Together, the rod 405 and bushing 410 cooperate to prevent rotation of the piston 170 as the piston 170 moves between the first and second positions during a production cycle of operation. The linear actuator 155 is preferably provided with an encoder or feedback device 415. The encoder 415 provides feedback signals to, for example, the control system 35 to control the dispensing of fluid product 55.

Figure 6A:
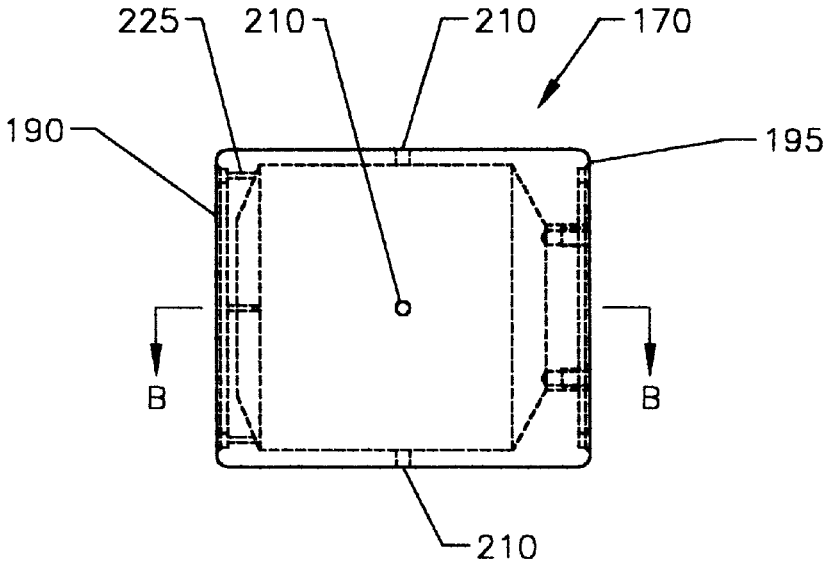
FIGS. 6A–6E are several views of an embodiment of a piston that can be used in the embodiment of the pump mechanism illustrated in FIG. 2.
Figure 6B:
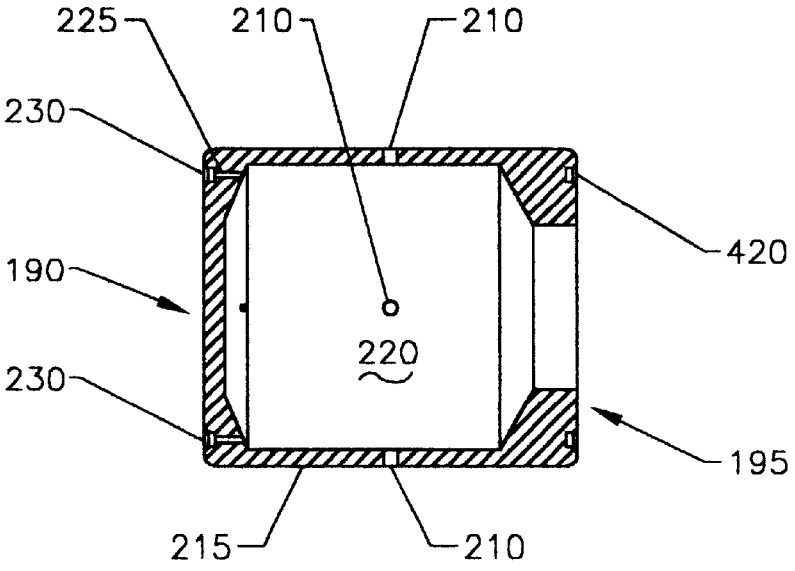
Figure 6C:
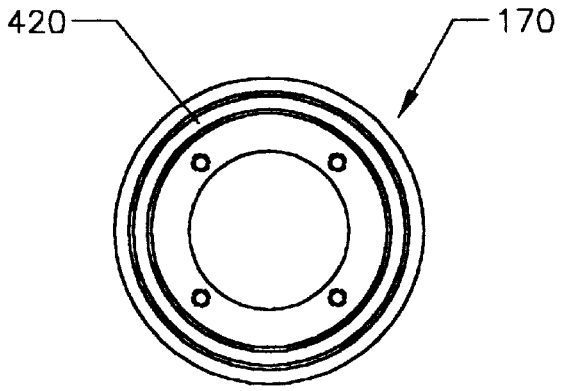
Figure 6D:
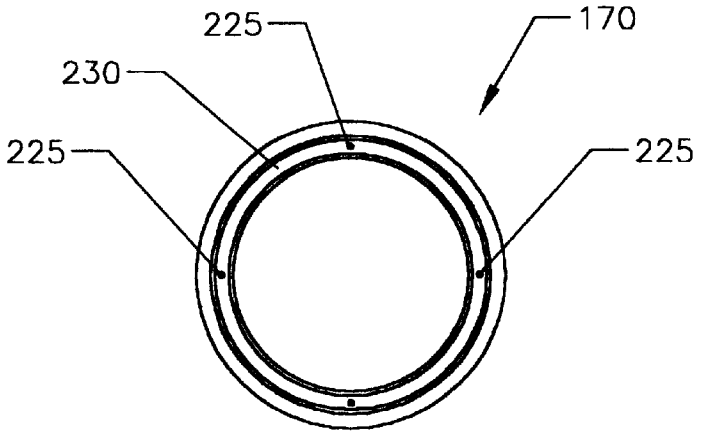
Figure 6E:
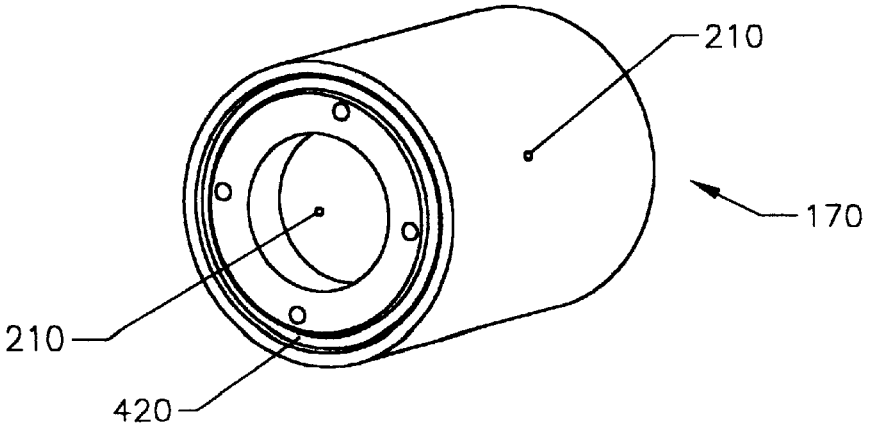

FIGS. 6A–6E illustrate several views of an embodiment of the piston 170 for use in the present fill pump mechanism. To summarize, FIG. 6A is a side view of the piston 170 using hidden lines to illustrate various features of the piston 170. FIG. 6B is a cross sectional view of the piston 170 taken along line B—B of FIG. 6A. FIG. 6C is an end view showing mounting holes used in the connection of the piston 170 to the linear actuator 155. FIG. 6D is an opposite end view of the piston 170 illustrating vacuum ports. Finally, FIG. 6E illustrates a perspective view of the piston 170. A further recessed groove 420 is shown and may be utilized to maintain the position a further raised head 425 on the second diaphram 185.

Figure 7:
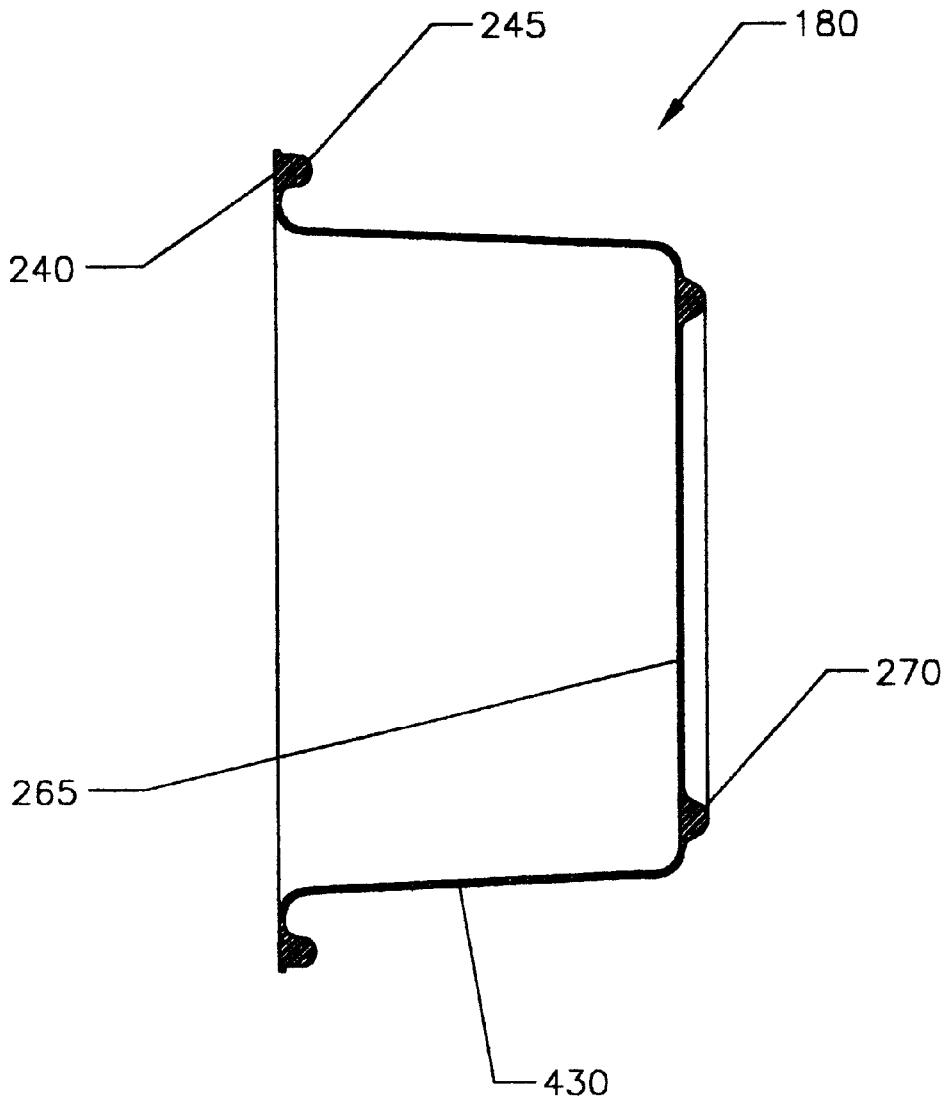
FIG. 7 is a side view of an embodiment of a diaphragm that can be used in the pump mechanism of FIG. 2.

FIG. 7 is a side view of an embodiment of a diaphragm 180. The diaphragm 180 has a substantially cylindrical sidewall 430. As set forth above, the diaphragm 180 the flange 240 and rear face 265. The diaphragm 180 is preferably circular. The diaphragm 180 also preferably includes the raised beads 245, 270 on each surface 240, 265, respectively. The raised bead 245, 270 is preferably semi-circular in cross section.

The fill pump mechanism 75 operates with a preselected motion profile that is under control of, for example, the controller 35. There are two main points of interest in such a motion profile.

The first point of interest occurs when the piston 170 is driven forward so that the first diaphragm 180 is pushing fluid product 55 from the pump chamber 135. Near the end of travel, the piston 170 slows down. This slowing of the piston 170 creates a negative force on the first diaphragm 180, which tends to separate the first diaphragm 180 from the head portion 190 of the piston 170. The vacuum forces holding the first diaphragm 180 to the head portion 190 of the piston 170 must necessarily be greater than this negative force on the first diaphragm 180 caused by the slowing of the piston 170.

A second point of interest in the motion profile occurs at the beginning of the piston motion in the reverse direction which acts to suction the fluid product 55. Another negative force on the first diaphragm 180 is created by this initial retraction of the piston 170 and first diaphragm 180. Again, as before, the vacuum forces must exceed the negative forces to maintain the first diaphragm 180 against the head portion 190 of the piston 170. The motion profile is thus primarily a series of constant accelerations, with the two exceptions described above, which are overcome by the vacuum forces within the piston 170 holding the first diaphragm 180 to the piston 170.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

We claim:

1. In a fill system for a packaging machine, a pump mechanism for pumping a product that is dispensed by the fill system, the pump mechanism comprising:

a) a pump chamber for conducting the product therethrough;

b) a further chamber disposed proximate the pump chamber;

c) a piston disposed in the further chamber, the piston having at least one first opening in fluid communication with the further chamber and at least one second opening disposed at a head portion of the piston, the piston including at least one channel for providing fluid communication between the first and second openings;

d) a first diaphragm secured over the head portion of the piston and against the at least one second opening, the first diaphragm being secured to the head portion using suction forces resulting from an underpressure communicated through the first opening to the at least one second opening via the at least one channel;

e) the piston and first diaphragm being reciprocally movable within the further chamber and pump chamber between a first position in which the pump chamber has a first volume and a second position in which the pump chamber has a second volume that is greater than the first volume.

2. A fill system as claimed in claim 1 wherein the further chamber is an evacuated chamber and wherein the at least one first opening is in fluid communication with the evacuated chamber, the evacuated chamber being connected to a source of underpressure.

3. A fill system as claimed in claim 2 wherein the evacuated chamber is sealed at one end thereof by the first diaphragm and at a second end thereof by a second diaphragm opposite the first diaphragm.

4. A fill system as claimed in claim 2 wherein the piston comprises:

a) a sidewall defining a substantially hollow interior manifold chamber; the at least first opening being disposed through the sidewall;

b) the head portion comprising a channel disposed about a peripheral portion thereof;

c) the at least one second opening and a plurality of further openings being disposed in the channel.

5. A fill system as claimed in claim 4 wherein the first diaphragm comprises a raised bead extending from the first diaphragm and engaged within the channel of the head portion of the piston.

6. A fill system as claimed in claim 1 and further comprising a linear actuator connected to drive the piston between the first and second positions.

7. A fill system as claimed in claim 6 wherein the evacuated chamber is sealed at one end thereof by the first diaphragm and at a second end thereof by a second diaphragm opposite the first diaphragm, the second diaphragm separating the linear actuator from the evacuated chamber.

8. A fill system as claimed in claim 7 wherein the linear actuator is a servomotor.

9. A fill system as claimed in claim 1 wherein the pump chamber comprises:

a) a pump head section having a product inlet and a product outlet;

b) a hollow cylinder secured to the pump head section, the first diaphragm having a flanged portion that is secured at the interconnection of the pump head section and the hollow cylinder.

10. A fill system as claimed in claim 9 wherein the hollow cylinder is secured to the pump head section by a V-clamp connection.

11. A fill system as claimed in claim 1 wherein the evacuation chamber comprises:

a) the hollow cylinder; and b) a further hollow cylinder secured to the hollow cylinder, the second diaphragm having a flanged portion that is secured at the interconnection of the hollow cylinder and the further hollow cylinder.

12. A fill system as claimed in claim 11 wherein the evacuation chamber further comprises a vacuum port disposed through a sidewall of the hollow cylinder.

13. A pump assembly including a cylinder having a hollow pump chamber, the assembly comprising:

a) a piston having an elongated, generally cylindrical hollow body extending between a first face and a second face, the hollow body forming a cavity between the first face and the second face;

b) a plurality of throughholes formed in the first face of the piston, the throughholes being in fluid communication with the cavity;

c) a first diaphragm arranged over the throughholes at the first face of the piston;

d) a second diaphragm connected at the second face of the piston;

e) a linear actuator constructed and arranged to drive the piston in a reciprocating motion in the hollow chamber of the cylinder;

f) mounting means disposed between the cylinder and the linear actuator for carrying the assembly; and g) means for providing a vacuum in the cavity of the piston, the vacuum holding the first diaphragm to the first face of the piston during operation.

14. The pump assembly of claim 13 and further comprising:

a) a circular raised bead formed on the first diaphragm.

15. The pump assembly of claim 14 further comprising:

a) a channel formed in the first face of the piston, the channel being dimensioned such that the circular raised bead of the first diaphragm is cooperatively arranged in the channel.

16. The pump assembly of claim 13 and further comprising:

a) a channel formed in the first face of the piston, the channel being dimensioned such that the plurality of throughholes are arranged in the channel.

17. The pump assembly of claim 13 further comprising:

a) a circular raised bead formed on the second diaphragm.

18. The pump assembly of claim 17 further comprising:

a) a circular groove formed in the second face of the piston, the groove being dimensioned such that the raised bead of the second diaphragm is cooperatively arranged in the groove.

19. The pump assembly of claim 13 wherein the mounting means further comprises:

a) a motor cradle including a plate portion connected to a cylindrical-shaped portion, the cylindrical-shaped portion having a first end connected to the cylinder and a second end connected to the linear actuator.

20. The pump assembly of claim 19 wherein the motor cradle further comprises:

a) a cutout portion arranged in the cylindrical-shaped portion.

21. The piston diaphragm assembly of claim 19 wherein the mounting means further comprises:

a) securement means for connecting the cylindrical-shaped portion to the cylinder.

22. The pump assembly of claim 13 further comprising:

a) a plurality of apertures formed in the body of the piston.

23. The pump assembly of claim 22 further comprising:

a) an evacuated region located within the cylinder between the first diaphragm and the second diaphragm, wherein the evacuated region is in fluid communication with the cavity in the body of the piston via the plurality of apertures formed in the body of the piston.

24. The pump assembly of claim 23 wherein the evacuated region is in fluid communication with the means for providing a vacuum in the cavity in the body of the piston.

25. The pump assembly of claim 13 wherein the first diaphragm further comprises:

a) a generally cylindrical body extending between a first surface and a second surface, the first surface being connected between the pump head and the cylinder and the second surface being arranged at the first face of the piston.

26. The pump assembly of claim 25 further comprising:

a) a circumferential lip arranged at the first surface of the first diaphragm and a first corresponding channel formed in the cylinder so that the circumferential lip is disposed in the first corresponding channel between the pump head and the cylinder.

27. The pump assembly of claim 13 wherein the second diaphragm further comprises:

a) a generally cylindrical body extending between a first surface and a second surface, the first surface being connected between the linear actuator and the mounting means and the second surface being connected to the second face of the piston.

28. The pump assembly of claim 27 further comprising:

a) a circumferential lip arranged at the first surface of the second diaphragm and a second corresponding channel formed in the cylinder so that the circumferential lip is disposed in the second corresponding channel between the mounting means and the cylinder.

29. A pump assembly comprising:

a) a piston having a first face and a second face, the piston including a cavity formed therein;

b) means for generating a vacuum in the cavity of the piston;

c) a plurality of throughholes formed in the first face of the piston, the throughholes being in fluid communication with the cavity;

d) a first diaphragm arranged over the throughholes at the first face of the piston; and e) a linear actuator constructed and arranged to drive the piston in a reciprocating motion in a hollow chamber of a cylinder.

* * * * *